United States Patent [19]

Bernasconi

[11] Patent Number: 5,064,475

[45] Date of Patent: Nov. 12, 1991

[54] PROCESS FOR STRIPPING A LAYER OF PAINT FROM THE SURFACE OF A SUPPORT

[75] Inventor: Attilio Bernasconi, Alzate di Mono/No, Italy

[73] Assignees: Sio, Societa Per L'Industria dell'Ossigeno e di Altri Gas, Milan; Beta Ricerche & Sviluppi di Attilio Bernasconi & C. s.a.s., Alzate di Mono, both of Italy

[21] Appl. No.: 317,955

[22] Filed: Mar. 2, 1989

[30] Foreign Application Priority Data

Mar. 4, 1988 [IT] Italy ..... 19652 A/88

[51] Int. Cl.[5] ..... B08B 7/00; B08B 3/39

[52] U.S. Cl. ..... 134/4; 134/9; 134/38; 134/41; 34/5; 34/22; 34/23; 427/154; 427/156; 427/309; 264/28; 264/338

[58] Field of Search ..... 264/28, 338; 427/154, 427/156, 309; 134/4, 38, 41, 9, 28; 34/5, 22, 23

[56] References Cited

U.S. PATENT DOCUMENTS

| | | | |
|---|---|---|---|
| 4,398,961 | 8/1983 | Mason | 134/38 |
| 4,554,025 | 11/1985 | Burke et al. | 134/17 |
| 4,844,833 | 7/1989 | Komatsu et al. | 134/38 |
| 4,867,900 | 9/1989 | Komatsu et al. | 134/38 |

FOREIGN PATENT DOCUMENTS

| | | |
|---|---|---|
| 0147984 | 10/1985 | European Pat. Off. . |
| 3105088 | of 1982 | Fed. Rep. of Germany . |
| 346132 | 11/1985 | Fed. Rep. of Germany . |
| 1385409 | of 1963 | France . |

OTHER PUBLICATIONS

Raymond R. Mayers and J. S. Long, Treaties on Coatings/vol. 4, Formulations Part 1, Marcel Derrer, New York, 1975, pp. 37, 68–70.

C. F. A. Tayor & S. Marks, Paint Technology Manuals Part Three convertible Coatings, Charman & Hall:London, 1962., pp. 154–174.

*Primary Examiner*—Theodore Morris
*Assistant Examiner*—Zeinab El-Arini
*Attorney, Agent, or Firm*—Oblon, Spivak, McClelland, Maier & Neustadt

[57] ABSTRACT

The invention relates to a process for stripping, from the surface of a support, a layer of paint which has been formed and hardened thereon, characterized by the requirement of a phase of pre-treating said support before the formation on the latter of the layer of paint to be stripped, said treatment consisting in applying on the support a covering product, selected among the following products: a pre-treatment vinyl resin paint, a polyurethane resin paint. It is also an object of the invention to provide products and compositions to be used in said process.

3 Claims, No Drawings

PROCESS FOR STRIPPING A LAYER OF PAINT FROM THE SURFACE OF A SUPPORT

BACKGROUND OF INVENTION (a) Field of the Invention

This invention relates to a process for stripping a layer of paint from the surface of a support. More particularly, the invention relates to a pre-treatment of the support before forming a layer of paint thereon.

(b) Description of Prior Art

On a technical aspect, it is known to strip a layer of paint from an object, so as to suitably revarnish the latter or to remove the paint therefrom, whether the latter is temporary, non desired or unavoidable.

In the present description, and for simplification, the technique of stripping a layer of paint from an object will be referred to by the .term "stripping".

With respect to the problem, which is the object of the present patent, we know, for example, that after many cycles of work, the frames of painting installations are unusable because of the thick layer of accumulated paint which, on the one hand results from an excessive utilization of paint and, on the other hand, implies a heat consumption waste during the polymerization reaction at the stage where said paint is baked in an oven. Moreover, there are other problems such as the substantial weight increases and the progressive thermic insulation of the frames, which render all the electrostatic methods of varnishing inefficient. It is therefore necessary to replace the frames or to strip the layers of varnishing product which have accumulated to give them their original aspect, such as by "stripping".

The technique which is known has proposed many methods of stripping.

According to Italian Patent Application No. 0915 A/86, the layers of paint covering a support can be stripped by breaking down these layers by cooling at low temperature with liquefied gases and, eventually, executing a corresponding final mechanical stripping.

This technique of immersion in liquefied gas is relatively efficient but can often have anti-economical aspects insofar as the use and consumption of large quantities of said gas and the necessity of an extended mechanical action with installation and management costs.

SUMMARY OF INVENTION

The aim of the present invention is to propose an improved process for stripping layers of paint, which leads to a decrease or even, in certain cases, an elimination of the quantity of liquefied gas required for stripping, or of the maintenance time of the support in the gas.

The other aim of the invention is to reduce or, in certain cases, to eliminate the mechanical action per se of finishing which is carried out for a complete stripping of the layer of paint.

To reach this aim and to obtain other advantages defined later, the present invention proposes a process of stripping, from the surface of a support, a layer of paint which has been formed and hardened thereon, characterized by the requirement of a phase of pretreating this support before the formation on the latter of said layer of paint to be stripped, said treatment consisting in applying on the support a covering product, selected among the following products: a vinyl resin pre-treatment paint, a polyurethane resin paint.

To carry out the process according to the invention, the covering product is a vinyl resin pre-treatment paint.

DESCRIPTION OF PREFERRED EMBODIMENTS

Preferably, there is used a liquid product obtained with a base of vinyl paint in a solvent such as acetone, "toluolo" and "xilolo", to which a metallic aluminum powder (or a powder of other metals or non-metals, which are electrical conductors) can be added to give, with chloride solvents and synthetic solvents, a maximum viscosity.

This product preferably will have a composition selected among the following:

| | |
|---|---|
| standard vinyl paint | 40–60% |
| highly resistant vinyl paint | 20–40% |
| chloride solvent | 10–20% |
| organic solvent | 5–20% |

This product may also contain 1–5% of aluminum powder or a powder of other electrically conductive materials to provide the necessary electrical contact in the case of an electrostatic varnishing.

This product does not deteriorate in alkaline degreasing or acid phospho-degreasing baths, even at a bath temperature of 70° C. and cannot even pollute them. It also withstands air temperatures of the order of 140° C. for a holding time shorter than 10', without modifying its own physico-chemical characteristics.

The application of the product can be carried out by immersion of the support which is then allowed to rest for a few minutes. The support can also be sprayed by means of a mixed airgun and allowed to rest for a few minutes. In both cases, the viscosity of the product should permit a deposit of the same thickness, about 20, (viscosity of 15–18" on the "cut" Ford No. 4).

Because of its vinyl base, this pretreatment product produces an anti-adhesive action, thus preventing the paint layers from adhering to the support. These characteristics can be improved by the particles of aluminum powder which render the pre-treatment heterogeneous, and decreases the adhesions between the product and the support, or between the molecules themselves of the product.

Another characteristic of the product is that, under the effect of the heat of polymerization during the phase of baking the layer of paint and because of a mixture of solvents, a gas is freed which, in view of its increase of volume, forms bubbles, so that the adhesion surface of the layers of paint are substantially decreased, down to 50%.

During another phase of the process according to the invention, the covering product will include a polyurethane resin pre-treatment paint.

The preferred paint will be an aromatic polyurethane powdered paint, which rapidly polymerizes, and is highly thyxotropic (20'×160° C.).

This pre-treatment paint may contain 5% aluminum powder and other conductive materials to ensure the required electrical contact for electrostatic varnishing.

This product does not deteriorate in alkaline degreasing or acid phospho-degreasing baths even at a bath temperature of 70° C. and even cannot pollute them. It can also withstand air temperatures of the order of 250°

C., for a holding time less than 10', without modifying its own physico-chemical characteristics.

This product is generally applied with electrostatic sprinkling systems which permit a deposit of at least 100 μm on the rough support (after polymerization). This product is polymerized by passing it through air at 130°-140° C. during 5'.

This pre-treatment produces a separation layer between the support and the layer of paint which is formed thereafter. Indeed, the product, by its high thixotropy, has a tendency to liquefy during polymerization, i.e. it has a tendency to behave as a thermoplastic rather than as a thermosetting material and consequently to produce an unstable adhesion between the layers of paint which are successively accumulated. In addition, during the polymerization, the product based on aromatic polyurethane produces, gaseous components.

Because of the layers of paint which have successively accumulated on the support, these gases cannot escape in the atmosphere and increase in volume under the effect of heat, to create at the level of the interface between the support and the layers of paint, a porous zone which is composed of very fragile open cells which make the separation layer still more unstable.

In a following phase of application, the process according to the invention includes, in addition to the phase defined above, a phase for the pre-treatment of the support before the formation of the layer of paint to be stripped.

This ulterior pre-treatment phase consists of a treatment of the support, with one or more acids, before the pre-treatment phase with the covering product.

By pre-treating the support by immersing it in an acid bath (for example a mixture of strong acids), an oxidation is produced on the entire surface of the support which will facilitate the adhesion of the covering product which will be applied thereto.

This phase is mainly used for those supports which, as a result of numerous sanding treatments, present an irregular surface on which the covering product would adhere more difficultly.

In an ulterior phase of application of the process according to the invention, the latter comprises a phase of warming the support on which the layer of paint to be stripped has already been formed.

During this phase, after passing through an oven, the support is placed in a draft of air whose temperature varies between 150° and 250° C. (preferably between 200° and 220° C.), during 10 to 30' (preferably 20').

This phase produces an increase of the gas formed in the covering product used for the pre-treatment phase and also a carbonization thereof, with formation of ashes. These effects contribute to increase the instability of the layer of paint to be stripped.

After the pre-treatment phase with a covering product, the process according to the invention can easily lead to the final phase where the support on which the layer of paint to be stripped has been formed is contacted with at least a liquefied gas, such as nitrogen, according to the method described in Italian Patent Application No. 20915 A/86 mentioned above.

The contact between the support and the cryogenic liquid gas produces a crack with a rupture of the layer of paint to be stripped which can lead to a total separation of the layer. If this is not produced, the separation and stripping will be completed mechanically, such as manual or automatic sanding, shot-blasting, etc.

The final phase consisting of the immersion in a liquefied gas is preferable but not indispensable.

In particular, this action can be avoided when the covering product of the pre-treatment phase is a vinyl resin pre-treatment paint. In this case, an anti-adhesion action and the increase of the gas during the polymerization phase will give a nearly total separation of the layer to be stripped.

For the purpose of better describing the process according to the invention, we present hereinafter a non exhaustive example of practical use.

EXAMPLE

On a clean support, intended to carry pieces to be varnished, a pre-treatment is carried out by applying on this support a covering product whose composition is the following:

| | |
|---|---|
| 50% | standard vinyl paint |
| 28% | highly resistant vinyl paint |
| 2% | metallic aluminum powder |
| 12% | chloride (1,1,1-trichlorethane) solvent |
| 8% | 1,2-dichloropropane solvent, "toluolo" |
| 100% | |

The application was carried out by immersion of the support and the latter was allowed to rest for a few minutes.

It is also an object of the present invention to provide a system especially adapted for carrying out the process described above.

For example, a system adapted for the process according to the invention comprises, in the automatic embodiment, an elevator to which are suspended the supports to be treated and which are allowed to go through the following operating phases:

immersion in a perfectly insulated recipient containing the cryogenic fluid for a time required for this phase, passage in the shot-blasting machine with granules of a caliber of 2-6 mm, for stripping, air drying the condensation mist formed on the supports, acidification in a stainless steel recipient containing a solution of strong acids, holding at room temperature, application of the liquid pre-treatment by immersion and sprinkling, or application of the electrostatic powder pre-treatment, holding at room temperature or polymerization at 130°-140° C. during 5', unloading, loading of supports.

The modes of construction should be adapted to the norms of utilization and the use of cryogenic fluids and to Patent No. 20915 A/86 mentioned above.

In a general manner, it will be understood that the process according to the invention greatly facilitates the stripping of a layer of paint or, generally, from any body to be stripped which would form on the support.

The action of preparing the support is such that it considerably reduces the consumption of liquefied nitrogen or of any other appropriate liquefied gas which is needed for stripping. It also reduces the time of holding the support in the recipient of liquefied gas and, finally, it reduces the entire mechanical action necessary for stripping.

I claim:

1. A process for stripping a layer of paint from a surface of a support, comprising:

(i) pre-treating said support with one or more acids to oxidize the surface;

(ii) further treating said support by applying thereto a covering product which is at least one member selected from the group consisting of vinyl resin pre-treatment paints and polyurethane resin pre-treatment paints;

(iii) causing paint to contact said surface and harden thereon;

(iv) stripping said paint after having hardened said support surface by heating said support.

2. The process of claim 1, wherein step (iv) is followed by (v) immersing said support in a cryogenic liquid.

3. The process of claim 2, wherein step (v) is followed by (vi) mechanically stripping any paint still adhering to said support surface.

* * * * *

UNITED STATES PATENT AND TRADEMARK OFFICE

CERTIFICATE OF CORRECTION

PATENT NO. : 5,064,475

DATED : November 12, 1991

INVENTOR(S) : Attilio Bernasconi

It is certified that error appears in the above-identified patent and that said Letters Patent is hereby corrected as shown below:

On the title page, item [75] the inventor's residence is incorrect, it should be as follows:

--Alzate di Momo/No--, and item [73] the second assignee's residence is incorrect, it should be, --Alzate di Momo/No--.

Signed and Sealed this

Thirteenth Day of April, 1993

*Attest:*

STEPHEN G. KUNIN

*Attesting Officer*

*Acting Commissioner of Patents and Trademarks*